United States Patent [19]

Taylor et al.

[11] 3,990,257

[45] Nov. 9, 1976

[54] METHOD FOR COOLING WORKPIECES IN A LIQUID BATH

[75] Inventors: Harold L. Taylor, Hebron, Ind.; John M. Marshall, South Holland, Ill.

[73] Assignee: Inland Steel Company, Chicago, Ill.

[22] Filed: May 21, 1975

[21] Appl. No.: 579,301

Related U.S. Application Data

[62] Division of Ser. No. 358,480, May 9, 1973, Pat. No. 3,897,230.

[52] U.S. Cl. ..... 62/63; 72/201; 164/89; 164/283 S; 266/114

[51] Int. Cl.[2] ..... F25D 13/06

[58] Field of Search ..... 266/4 S, 6 S; 72/201; 164/283 S, 89; 62/63, 188, 266, 373, 374, 375, 378; 148/153; 134/114, 122, 199

[56] References Cited

UNITED STATES PATENTS

| | | | |
|---|---|---|---|
| 1,859,359 | 5/1932 | Fisk | 266/6 S |
| 2,287,825 | 6/1942 | Postlewaite | 62/63 X |
| 2,655,795 | 10/1953 | Dyer | 62/188 X |
| 3,245,671 | 4/1966 | Takaishi | 266/4 S |
| 3,420,083 | 1/1969 | Safford et al. | 72/201 |
| 3,423,254 | 1/1969 | Safford et al. | 266/4 S X |
| 3,531,334 | 9/1970 | Schrader et al. | 148/153 |
| 3,546,911 | 12/1970 | Lenz | 72/201 |
| 3,675,908 | 7/1972 | Amend | 266/6 S |
| 3,687,145 | 8/1972 | Schrader | 134/114 |

FOREIGN PATENTS OR APPLICATIONS 1,847,039 2/1962 Germany

*Primary Examiner*—William E. Wayner
*Assistant Examiner*—Ronald C. Capossela
*Attorney, Agent, or Firm*—Hibben, Noyes & Bicknell, Ltd.

[57] ABSTRACT

A cooling system for cooling steel slabs or the like comprises an elongated tank with parallel rollers for conveying the heated slab horizontally beneath the surface of a water bath. Water curtains from angularly directed upper and lower nozzles seal the entry opening in the end of the tank through which the slab is introduced into the tank and also supply cooling water to the tank. The rollers have axially spaced disk portions for supporting the slab in spaced relation above guide plates or aprons extending between the rollers. Inlet cooling water from the lower water curtain impinges against the lower surface of the slab and is diverted into and flows at high velocity through the restricted cooling channel defined between the guide plates or aprons and the underside of the slab. In a continuous form of the cooling system, a water curtain sealed outlet opening for the slabs is also provided in the opposite end of the tank. Intermediate cooling water nozzles may also be provided between the ends of the tank.

10 Claims, 13 Drawing Figures

METHOD FOR COOLING WORKPIECES IN A LIQUID BATH

This is a division of application Ser. No. 358,480, filed May 9, 1973, now U.S. Pat. No. 3,897,230.

This invention relates to a novel and improved cooling system for water cooling metal objects, particularly cast or hot rolled steel bodies such as slabs, plates, beams, bars, billets, rounds, and structural shapes. The invention includes both a novel method and a novel apparatus.

For many years hot steel slabs have been air cooled, but air cooling requires a long period of time, e.g. 16 to 24 hours, and results in a large inventory of slabs being cooled. In recent years water cooling facilities for slabs have been developed which have the advantage of faster cooling, reduction of slab inventory, and minimized scale formation. One type of slab cooler comprises a so-called "water wheel" in which slabs are introduced into radial compartments of a rotating wheel structure and immersed in a bath of agitated water. However, the capital cost of such equipment is quite high. Another type of slab cooler utilizes stationary banks of water sprays through which the slabs are conveyed. The principal disadvantages of spray-type coolers are the large water flow rates required, the large number of spray nozzles required, and the difficulties of obtaining and maintaining uniform cooling conditions. A further disadvantage of spray-type coolers is that they do not permit complete access to the slabs or other work-pieces because of the presence of the required piping and nozzles over the top of the tank.

The present invention provides an improved cooling system which can be used to cool a variety of products and which combines the advantages of rapid and uniform immersion cooling with low capital cost and ease of operation.

Accordingly, a primary object of the invention is to provide a novel and improved water cooling system for cooling steel objects and shapes which overcomes the disadvantage of the air cooling and water cooling systems heretofore known.

A further object of the invention is to provide a novel and improved water cooling system for steel slabs and the like which provides the advantages of immersion cooling but does not require massive and costly equipment for lifting and lowering the heavy material.

Another object of the invention is to provide a novel and improved water cooling system for steel slabs and the like which utilizes horizontal conveyor movement of the material being cooled but does not utilize water sprays which require high water flow rates and have serious maintenance problems.

A further object of the invention is to provide a novel and improved water cooling system for steel slabs and the like which is readily adapted for intermittent batch cooling of selected work-pieces or for continuous cooling of a succession of work-pieces.

Still another object of the invention is to provide a novel quench method and a novel quench apparatus for achieving the aforementioned results.

Other objects and advantages of the invention will become apparent from the subsequent detailed description taken in conjunction with the accompanying drawings, wherein.

Figures 9A, 9B, 10, 11, 12:
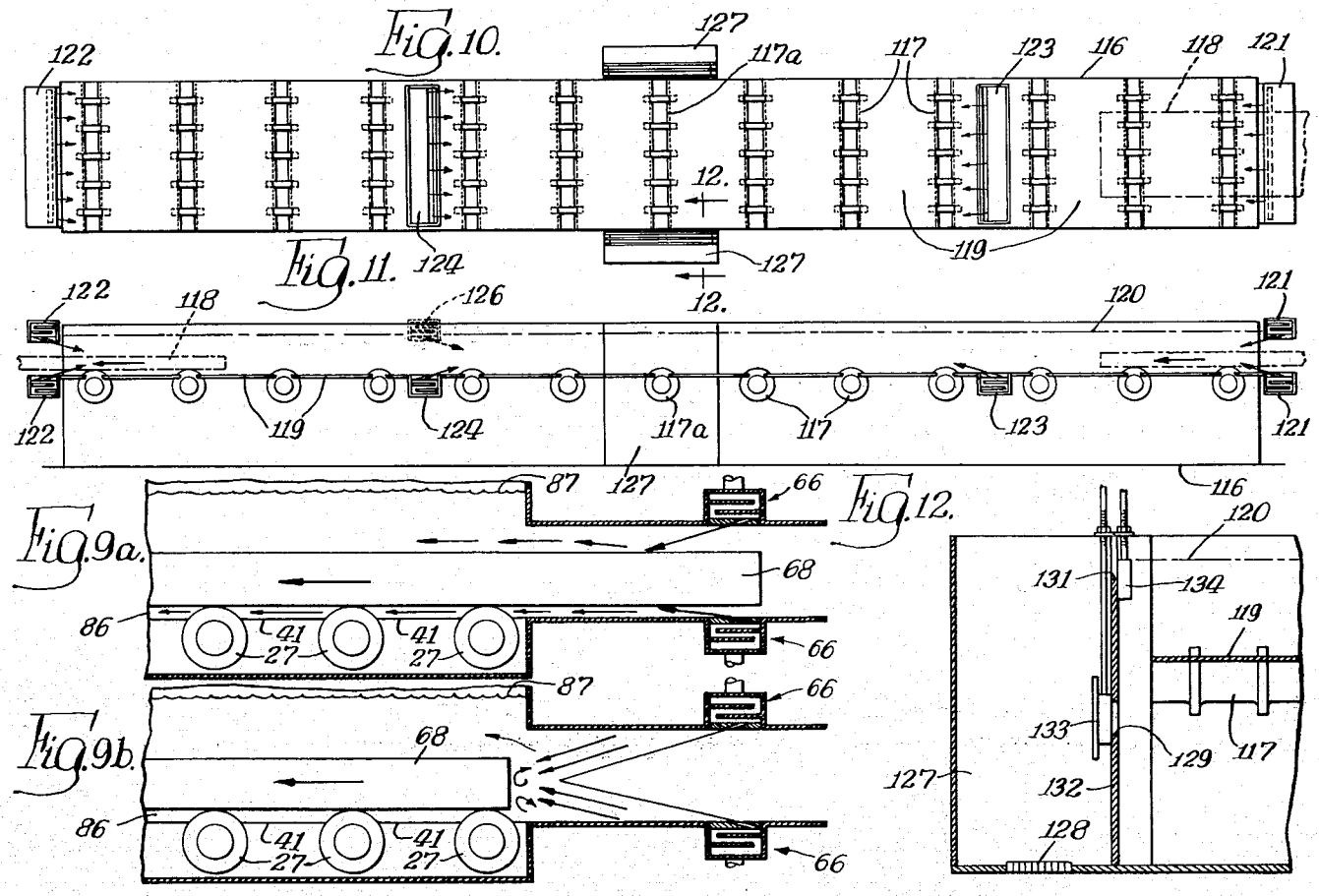

FIGS. 9*a* and 9*b* are schematic side elevational views showing the operating principles of the invention;

FIG. 10 is a schematic plan view of a further embodiment of the invention;

FIG. 11 is a longitudinal sectional view of the apparatus shown schematically in FIG. 10; and FIG. 12 is an enlarged fragmentary sectional view taken along the line 12—12 of FIG. 10.

The invention, briefly described, comprises an elongated cooling tank adapted to contain a water bath and having an inlet opening in an end wall for introducing a heated slab or other work-piece into the tank beneath the bath surface. A plurality of driven conveyor rollers are arranged in parallel relation spaced along the length of the tank, and the rollers are provided with axially spaced parallel disk portions for supporting the slab or work-piece and moving it horizontally into and out of the bath. Angularly disposed nozzles having slit orifices are arranged at the tank opening to provide angularly intersecting water curtains which seal the opening and prevent water from flowing out of the tank. Guide plates or aprons are disposed between adjacent rollers to provide a substantially continuous barrier or wall spaced slightly from the lower surface of the slab or work-piece supported on the roller disks. The angularly directed sealing water enters the elongated narrow cooling or quench channel thereby defined at the underside of the slab or work-piece and insures rapid and effective cooling at the underside. The sealing water is also directed in effective cooling relation along the upper surface of the slab or work-piece. For batch cooling, the slab or work-piece is moved into the cooling tank through the water curtains at the inlet opening and is then withdrawn reversely through the same opening. For a continuous operation, the tank may also have an exit opening at its opposite end which is provided with a similar nozzle arrangement for sealing the opening, in which case the slabs or work-pieces are conveyed continuously through the tank from one end to the other. For most efficient operation the center of the slab or work-piece should be in substantial alignment vertically with the intersection of the sealing water curtains at the tank inlet, and at least during the initial phase of the cooling, a portion of the slab or work-piece should be positioned in the water curtains. The presence of the slab or work-piece in the water curtains insures that the angularly directed curtains are impacted against the upper and lower horizontal surfaces of the slab or work-piece and are thence diverted longitudinally along these surfaces to obtain the desired effective cooling action.

FIGS. 1–9*b* illustrate one embodiment of the invention which is particularly suited for intermittent batch cooling of cast or hot rolled slabs. For example, as an adjunct to a continuous slab casting facility, it is very important to have a suitable means for effecting rapid cooling of selected slabs so that they may be evaluated promptly for quality control purposes. Although the invention will be described hereinafter with particular reference to slab cooling, it should be understood that the invention is also useful in cooling other articles such as plates, bars, billets, rounds, beams, and structural shapes.

Figures 6, 7, 8:
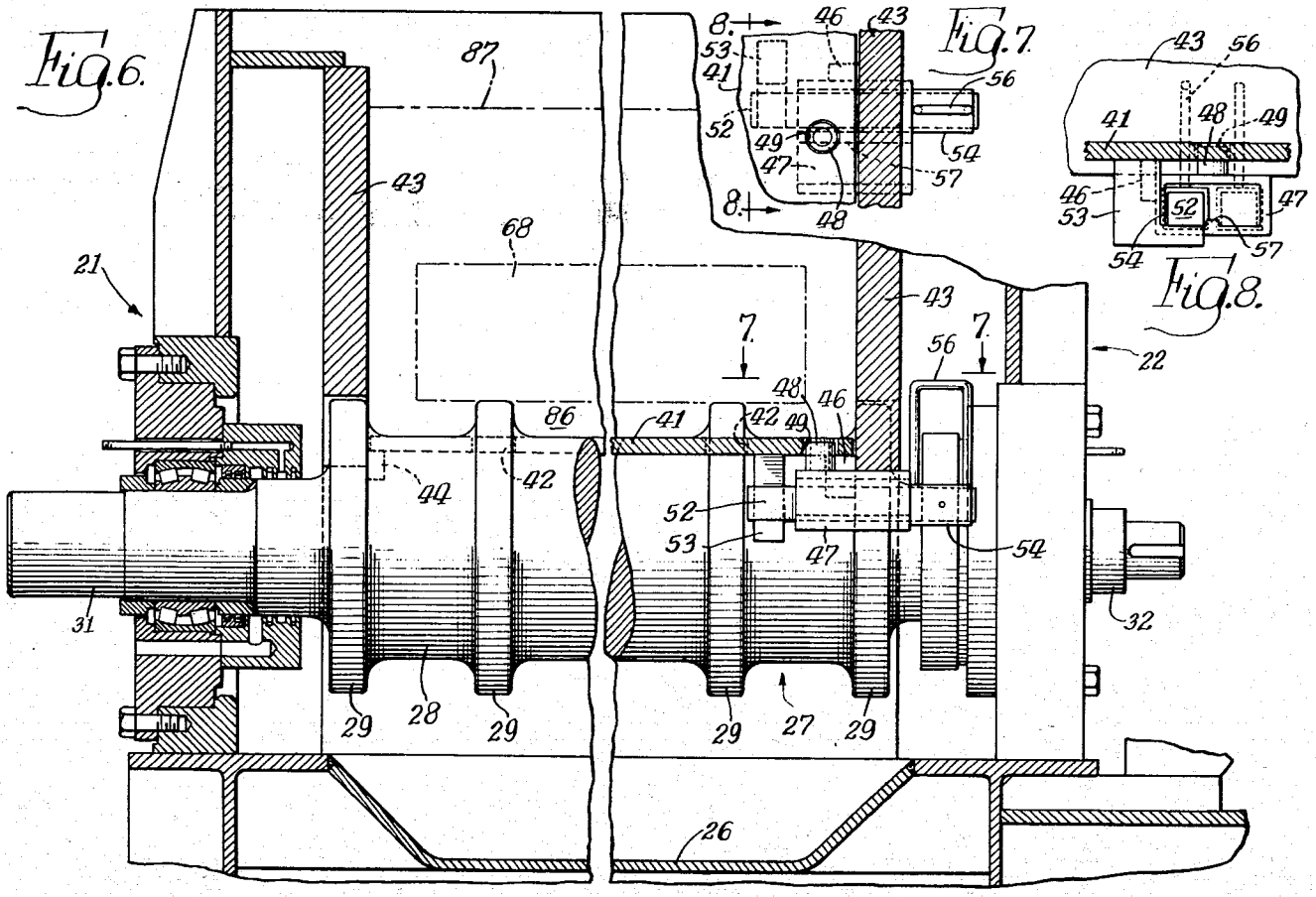
FIG. 6 is a broken transverse sectional view, on an enlarged scale, taken along the line 6—6 of FIG. 1.
FIG. 7 is a fragmentary view taken along the line 7—7 of FIG. 6.
FIG. 8 is a fragmentary view taken along the line 8—8 of FIG. 7.

An elongated rectangular open top tank 20 has side walls 21 and 22, end walls 23 and 24, and a bottom wall 26. A plurality of parallel conveyor rollers 27 are disposed transversely between the side walls of the tank 20 adjacent the bottom thereof and spaced longitudinally along the length of the tank. As best seen in FIG. 6, each roller 27 has a cylindrical body portion 28, a plurality of larger diameter disk-shaped portions 29 spaced axially along the body portion, and integral shaft portions 31 and 33 which are journalled in suitable bearings in the side walls 21 and 22, respectively. The shaft portions 31 of the rollers 27 are coupled, as at 33 (FIGS. 1 and 3), to gear reduction units 34 which are in turn connected to a plurality of electric motors 36 for driving the rollers.

Figure 1:
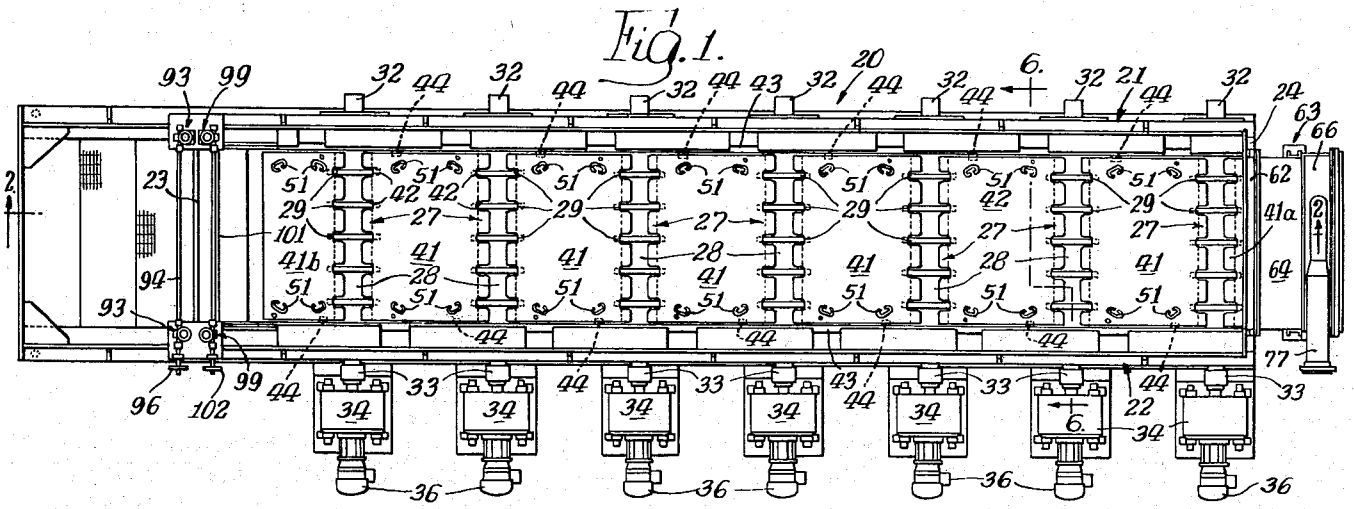
FIG. 1 is a top plan view of one embodiment of a slab cooling apparatus in accordance with the present invention.
Figure 2:
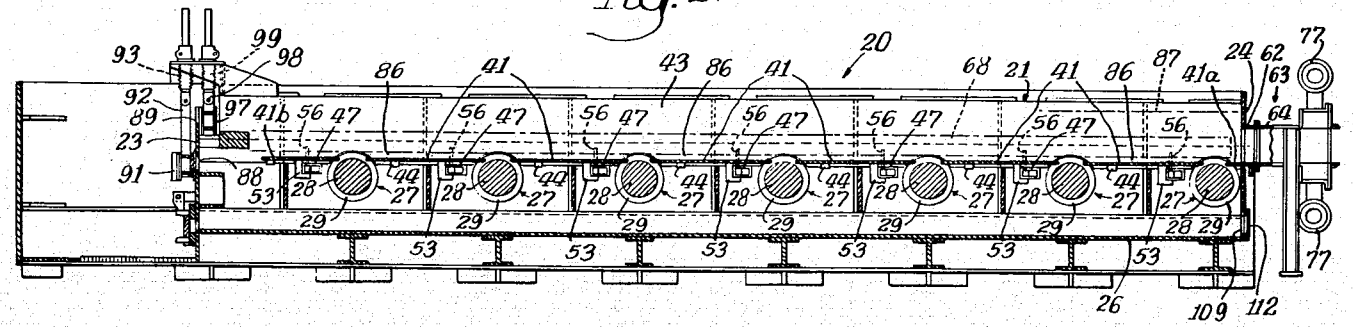
FIG. 2 is a longitudinal sectional view taken along the line 2—2 of FIG. 1.
Figure 5:
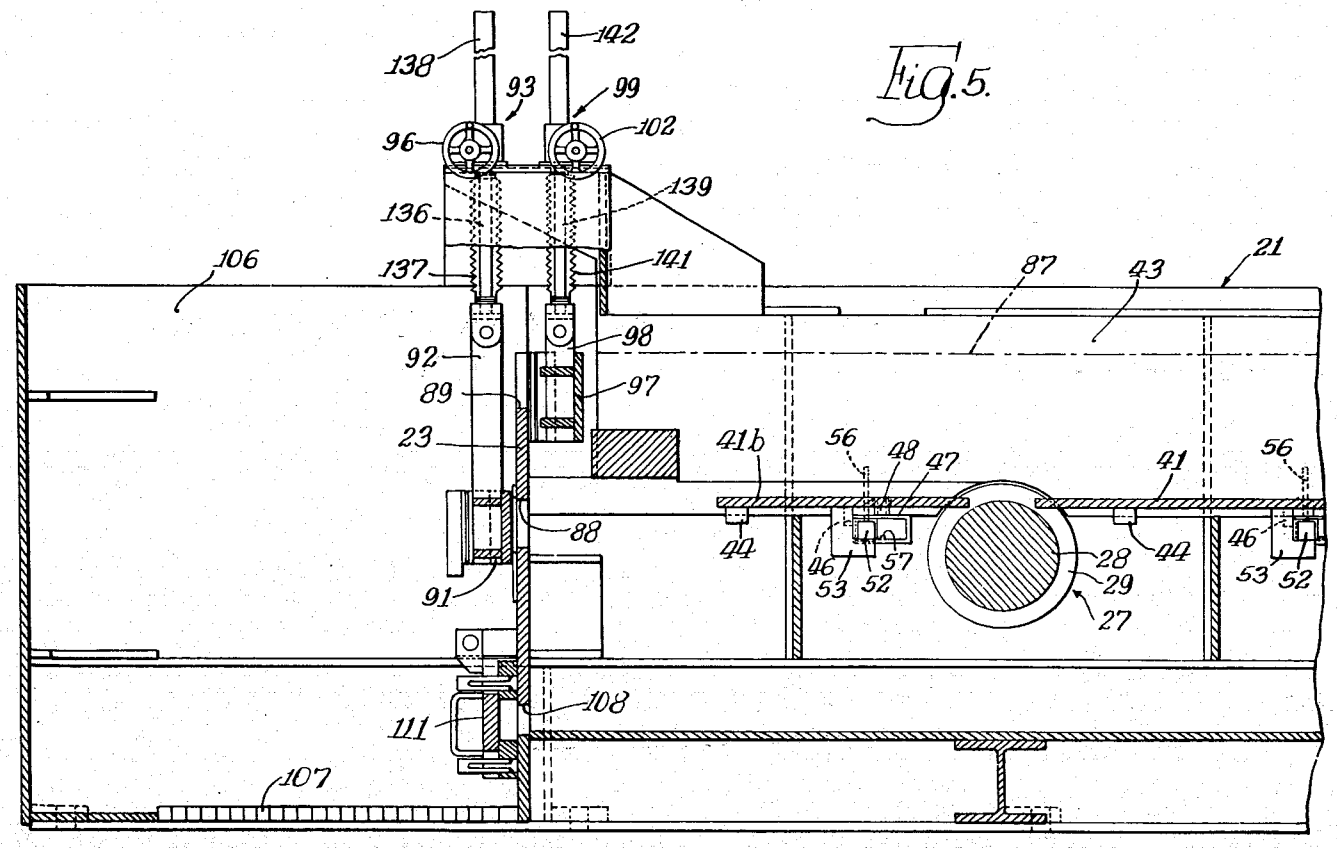
FIG. 5 is an enlarged view of the left-hand end portion of the structure shown in FIG. 2.

As hereinafter explained in greater detail, an important feature of the invention is the provision of a plurality of rectangular guide plates or aprons 41 interposed between the rollers 27 to provide a substantially continuous barrier or channel wall along the length of the tank 20 underlying the upper edges of the roller disk portions 29. As seen in FIGS. 1, 2, and 5, transverse edges of the aprons 41 fit with close clearance adjacent the body portions 28 and disk portions 29 of the rollers and are provided with edgewise slots or notches 42 to receive the disk portions 29. Each apron 41 is removably supported along its longitudinal edges by four projecting lugs or flanges which extend inwardly of the tank from the lower edges of a pair of elongated inner partitions 43 (FIG. 6) comprising part of the tank side wall structures 21 and 22. Two of these supporting lugs for each apron 41 are shown at 44, and the other two, designated at 46, are affixed to a pair of tubular box structures 47 secured to the partitions 43 and extending inwardly in slightly spaced relation below the apron. To insure proper alignment of the aprons 41 in relation to the rollers 27 when the aprons are supported on the lugs 44 and 46, each of the box structures 47 is provided with an upstanding tubular element 48 (FIG. 6) which is received in a corresponding aperture 49 in the apron 41. The aprons 41 are also provided adjacent their corners with C-shaped lifting holes 51 (FIG. 1) which are adapted to receive hooks, cables, or the like for lifting the aprons away from the tank structure when necessary for maintenance or other reasons.

Each of the aprons 41 is releasably retained in supported position on the lugs 44 and 46 by means of a pair of removable elongated locking pins 52 of rectangular cross-section which are inserted axially through the box structures 47 so that their inner ends are received in locking relation with L-shaped brackets 53 depending rigidly from the underside of the apron 41. The outer end portion of each locking pin 52 is detachably secured, as by a cotter pin or the like, in a socket member 54 of corresponding cross-sectional shape, and a handle or bail 56 projects rigidly from the socket member 54 for manipulating the locking pin. As best seen in FIGS. 7 and 8, the opening of the box structure 47 has a small upstanding transverse ridge or projection 57 which divides the interior of the box into two compartments or recesses. As shown in FIG. 8 in solid lines, when the locking pin 52 is in the left-hand compartment, the pin is in locking relation with the corresponding apron bracket 53. As shown in broken lines in FIG. 8, when the locking pin 52 is in the right-hand compartment, the pin clears the bracket 53 to permit removal of the apron. The locking pin 52 can be shifted between the two compartments by lifting the pin upwardly by the handle 56 until the pin clears the transverse ridge 57, the internal vertical dimension of the box structure 47 being slightly greater than the thickness of the pin 52 to provide the required clearance.

At the inlet end of the tank 20 (the right-hand end as seen in FIGS. 1 and 2), a narrow apron 41*a* (FIGS. 1, 2, and 4) is provided to bridge the gap between a rectangular opening 61 (FIG. 4) in the tank end wall 24 and the first roller 27. At the outlet end of the tank (the left-hand end as seen in FIGS. 1 and 2), a modified apron 41*b* is supported in close-fitting relation with the last roller 27.

Figure 3:
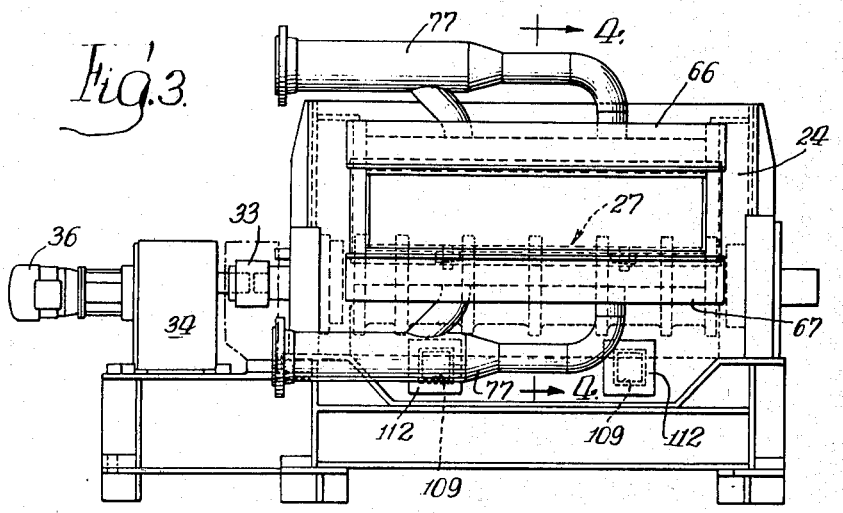
FIG. 3 is an end elevational view, on an enlarged scale, as seen from the right end of FIG. 1.
Figure 4:
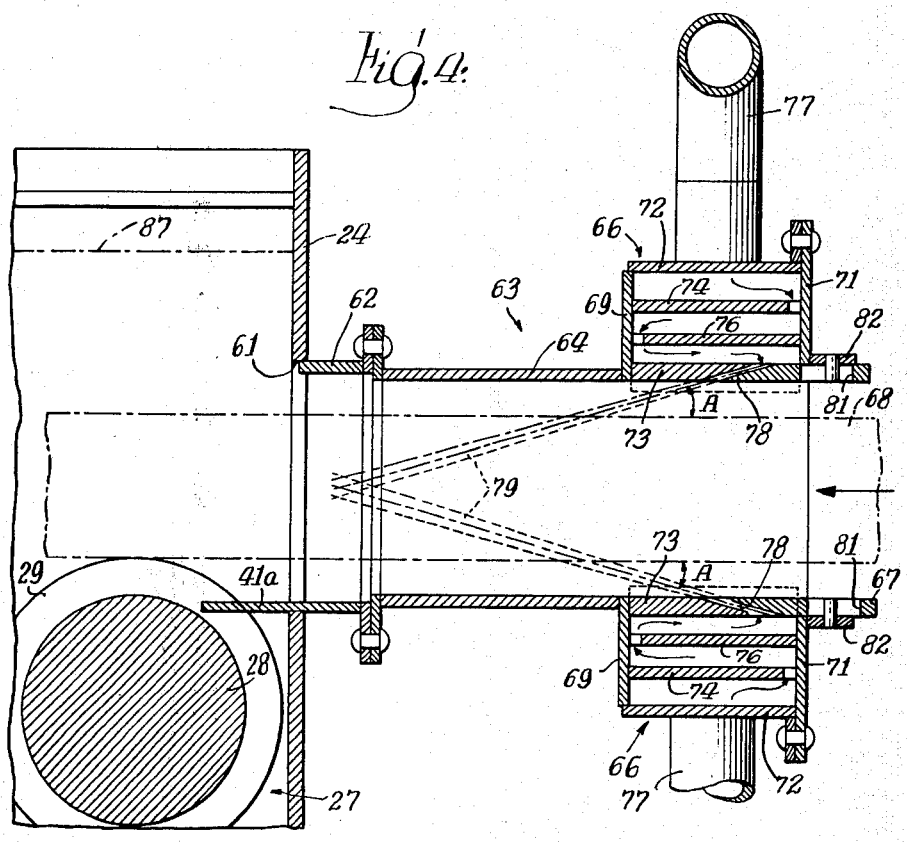
FIG. 4 is a fragmentary transverse sectional view, on an enlarged scale, taken along the line 4—4 of FIG. 3.

Referring particularly to FIGS. 3 and 4, it will be seen that the apron 41*a* comprises part of a rectangular tubular inlet 62 extending from the opening 61. A nozzle structure 63 is bolted to the inlet 62 and comprises a tubular mounting section 64 and a pair of elongated upper and lower nozzles 66 defining an inlet 67 for a slab 68. The nozzles 66 are preferably of the type described more fully in U.S. Pat. No. 3,360,202. Thus each nozzle 66 consists of an elongated rectangular housing having side walls 69 and 71, an outer wall 72, and an inner wall 73. Spaced parallel baffle members 74 and 76 are mounted within the housing to define a plurality of interconnected chambers. Cooling water is supplied to the nozzles 66 through upper and lower headers or manifolds 77, and the water flows in a tortuous path through the connected baffle chambers, as indicated by the arrows in FIG. 4, and is discharged through elongated angularly disposed slit orifices 78 in the inner walls 73 to provide uniform intersecting curtains or sheets of water in the section 64, as designated schematically at 79. The outer end portion of each wall 73 is laterally adjustable, by means of slotted portions 81 cooperating with a support flange 82, to vary the width of each slit orifice 78. The angle of the orifices 78 may vary but preferably is such that the water curtains 79 are at an acute angle of from about 10° to about 25° with respect to the horizontal, e.g. as indicated at A in FIG. 4. In practice, it has been found that an angle of about 15° to 17° is highly effective.

As seen in FIGS. 1, 4, and 6, the slab 68 is supported horizontally on the outer peripheries of the roller disk portions 29 which are all in substantial horizontal alignment. Thus, an elongated confined cooling channel 86 (FIGS. 2 and 6) is defined between the underside of the slab 68 and the substantially continuous wall formed by the rollers 27 and the aprons 41, 41*a*, and 41*b*. FIG. 9*a* illustrates schematically the water flow in relation to the slab 68. At the lower surface of the slab, the water flow from the lower angular water curtain impinges against the slab and is diverted into the inlet end of the channel 86 and flows at a high velocity through the channel 86. It will be understood that the narrow disk portions 29 of the rollers 27 support the slab 68 in spaced relation above the roller body portions 28 to permit continuous and substantially unimpeded flow through the channel 86.

In operation, the tank 20 is maintained full of water, the water level being substantially above the inlet opening 61, as indicated, for example, by the broken line 87. However, water is substantially prevented from flowing out of the opening 61 by means of the intersecting inwardly directed water curtains 79 which extend fully across the nozzle structure 63 and effectively seal the opening 61. Thus, the water from the nozzle structure 63 not only effects sealing of the slab entry end of the tank but also supplies the cooling water for the tank. In practice it has been found that the water flow rate required for cooling of the slab (e.g. in a cooling system operating in conjunction with a continuous slab caster casting eight to ten inch thick slabs at a casting rate of 50 to 100 inches per minute) is more than adequate to provide the desired sealing effect at the water curtains.

At the opposite end of the tank from the opening 61, as best seen in FIG. 5, the end wall 23 is provided with at least one water outlet, and preferably a pair of outlets. Thus, the end wall 23 has a rectangular submerged outlet opening 88 and a rectangular overflow opening or weir 89 at its upper edge. The submerged outlet opening 88 is controlled by a tranverse closure or gate 91 mounted for vertical movement relative to the opening 88 at wall 23 by means of a pair of straps 92 connected to worm gear jacks 93 located at opposite sides of the tank 20. The jacks 93 have elongated screw members 136 which are enclosed in flexible boots 137 and are raised and lowered in unison by worm gears (not shown) interconnected by a rotary shaft 94 (FIG. 1) having a hand wheel 96. When the screw members 136 are in their elevated positions they are received in tubular dust guards or caps 138. In a similar manner, the overflow opening 89 is controlled by a transverse closure or gate 97 mounted for vertical movement relative to the opening 89 at the inside of the wall 23 by means of a pair of straps 98 connected to worm gear jacks 99. The jacks 99 have screw members 139 enclosed in flexible boots 141, and the worm gears of the jacks are interconnected by a shaft 101 having an operating hand wheel 102. Dust guards or caps 142 receive the screws 139 in their elevated positions.

By regulating the positions of the closures or gates 91 and 97 in relation to the flow rate of the incoming water at the nozzle s tructure 63, the outlet flow of water is distributed between the openings 88 and 89 so as to maintain a substantially uniform flow velocity over the work-piece surfaces and at the same time maintain the desired substantially uniform water level in the tank. Regulation of the lower gate 91, which is submerged at all times, allows a predetermined flow of water through the outlet opening 88 as may be required to insure the desired high velocity through the channel 86. In this connection, it will be noted from FIG. 2 that the channel 86 is in substantial alignment with the opening 88.

The effluent water from the tank 20 passes through the openings 88 and 89 into an end compartment 106 formed by a continuation of the tank 20 at the downstream side of the end wall 23. The bottom of the compartment 106 has a grill 107 which serves as a filter for oxides scale, sludge, or the like, and the effluent water is discharged in whole or in part to a cooling and recirculation system (not shown) for return to the nozzle structure 63. As seen in FIG. 6, the bottom wall 26 of the tank 20 has a depressed or trough-shaped configuration which receives accumulated oxides, scale, sludge, or the like separated by the grill 107. When necessary the trough-shaped tank bottom is flushed out to remove accumulated foreign material by means of clean-out ports 108 (FIG. 5) and 109 (FIGS. 2 and 3) in the tank end walls 23 and 24, respectively. The clean-out ports are provided with removable closures 111 and 112.

In the operation of the cooling system, a slab 68 (or other heated work-piece) is fed into the inlet 67, in the direction indicated by the arrow in FIG. 4, by means of an aligned roller table or feed conveyor (not shown). As the leading end of the slab enters the water curtains 79, the water curtains impinge angularly against the upper and lower surfaces of the slab. As the slab 68 continues its movement, it engages the roller disk portions 29 and is supported thereon in spaced relation above the aprons 41*a*, 41, and 41*b* to provide the channel 86, as previously described. Since the rollers 27 are driven by the motors 36, the slab 68 is advanced into the tank beneath the bath surface and fully immersed in the water bath contained therein. The water introduced at the nozzles 66 flows lengthwise in the bath along the surfaces of the slab parallel to the direction of movement of the slab. In addition, as previously described in connection with FIG. 9*a*, the lower water curtain 79 after impinging angularly against the lower surface of the slab is diverted, at least in part, into the restricted channel 86 and flows at a high velocity therethrough. The high velocity flow of cooling water through the channel 86 results in uniform cooling of the slab at a high rate of heat transfer, thereby avoiding the formation of explosive pockets of steam at the underside of the slab. It has been found that during the initial portion of the cooling period for the slab (e.g. during the first five minutes when cooling a steel slab having a thickness of 8 to 10 inches), the channel cooling effect at the underside of the slab is essential in order to achieve the desired uniform cooling and avoidance of steam pockets. In the absence of the aprons 41, a loud rumbling noise is heard during the first few minutes of cooling which is indicative of inadequate or non-uniform cooling resulting in the formation of steam pockets. In addition, if the aprons 41 are not present, the resultant deeper water channel and lower velocity of flow at the underside of the slab tends to produce a lower rate of heat transfer at the underside of the slab than at the upper side. Consequently, differential cooling and warpage may occur.

It has also been found in practice that rapid uniform cooling of the upper surface and sides of the slab 68 is likewise obtained. As will be evident from FIG. 6, in the case of a wide slab the side edges of the slab 68 are relatively close to the tank partitions 43, thereby providing unobstructed high velocity flow of cooling water therebetween. At the upper surface of the slab 68 the flow of cooling water is completely unobstructed, and the upper water curtain 79 after impinging angularly against the upper surface of the slab 68 is diverted therealong at high velocity to achieve rapid uniform cooling. A similar effect is also realized at the sides of the work-piece in the case of slabs or shapes of lesser width.

Thus, with the present invention essentially all of the water discharged from the nozzle structure 63 at the sealing curtains 79 enters the tank 20 and flows parallel to the slab over substantially the entire length of the tank. An efficient utilization of the water for both sealing and cooling purposes is thereby achieved.

For the most effective water seal at the tank inlet, it is desirable that the horizontal axis of the slab 68 be substantially centered vertically on a horizontal line passing through the intersection of the water curtains 79, as shown in FIG. 4. Thus, in the case of a slab having a thickness of ten inches, the rollers 27 should be mounted so that the plane defined by the uppermost portions of the disk portions 29 is about five inches below the point of intersection of the water curtains 79. Absolute centering, however, is not essential and some deviation is permissible without destroying the water seal effect. For example, with the rollers 27 located as just described, a satisfactory water seal is also obtained when a slab eight inches thick is being cooled. If the apparatus is to be used for cooling work-pieces of widely varying thickness, then provision should be made for vertically adjusting the rollers 27 or the nozzle structure 63 relative to each other so that the work-piece can be centered approximately at the point of intersection of the water curtains.

As discussed above, it has been found that the channel cooling effect at the channel 86 is essential, especially during the initial phase of the cooling operation, in order to obtain uniform and efficient cooling. A further requirement in this regard is that the slab (or other work-piece) must be disposed in the inlet water curtains so as to obtain the angular impingement of the water curtains against the upper and lower surfaces of the slab as illustrated in FIG. 9*a*. A condition to be avoided, particularly in the initial phase of the cooling, is illustrated in FIG. 9*b* where the trailing end of the slab 68 is shown as having moved beyond the intersecting water curtains. In such case, the water curtains 79 impinge against the vertical end surface of the slab and are diverted in the opposite direction thereby hindering the desired high velocity channel flow of water along the length of the tank, particularly through the channel 86. This undesirable condition can be avoided by controlling the operation of the rollers 27 so that the slab is not moved into the tank far enough to clear the water curtains 79. For example, the slab is preferably stopped with a few inches of its trailing end protruding out of the water curtain. The rollers 27 are then reversed to withdraw the slab completely from the cooling tank onto the entry roller table or conveyor (not shown).

FIGS. 10–12 illustrate schematically a modification of the cooling apparatus for continuous cooling of successive slabs as contrasted with the intermittent batch cooling operation described heretofore in connection with FIGS. 1–9*b*. In the batch cooling operation, the heated slab is fed into the cooling tank inlet through the sealing water curtains and then retracted through the same opening upon completion of the cooling. In the continuous cooling operation (shown in FIGS. 10–12) the heated slab enters the cooling tank at one end beneath the bath surface and is removed from the opposite end of the tank beneath the bath surface. Thus, the cooling tank designated at 116 is provided with a series of rollers 117 (similar to the rollers 27 previously described) for supporting and conveying a slab 118. A plurality of aprons 119 are disposed between the rollers 117 to provide a restricted cooling channel beneath the slab as previously explained. The slab 118 is introduced beneath the surface 120 of the water bath in the tank through sealing water curtains from upper and lower nozzles 121 at one end of the tank and through an inlet opening in the tank end wall. The slab 118 is conveyed horizontally through the tank to the opposite end where the cooled slab is removed through an outlet opening in the tank end wall and through similar inwardly directed sealing water curtains from upper and lower nozzles 122. To avoid the undesirable condition illustrated in FIG. 9*b*, the slabs should be conveyed into the inlet end of the tank 118 in end-to-end abutted relation so that at all times a portion of a slab is present in the inlet water curtains. Similarly, it is also desirable that at all times a portion of a slab be present in the outlet water curtains in order to insure an effective seal and entry of the water into the tank.

As shown in FIGS. 10 and 11 supplementary water inlet nozzles 123 and 124 may be provided between the sides of the tank 116 adjacent the aprons 119. The nozzles 123 and 124 are similar to the lower nozzles 121 and 122 at the ends of the tank and are arranged to introduce cooling water into the restricted channel beneath the slabs 118 at a suitable angle so as not to impede or interfere with the flow of cooling water from the nozzles 121 and 122. These supplementary nozzles or jets are suitably located intermediate the ends of the tank in order to insure the required high velocity flow of cooling water in the restricted channel between the slabs 118 and the aprons 119. As will be evident from the drawing, the nozzles 123 and 124 are located downstream from the points of introduction of cooling water through the nozzles 121 and 122, respectively. The use of such supplementary nozzles is particularly important when the tank 116 is relatively long, as may be the case in a continuous system where the tank can accommodate a plurality of slabs at one time. Although not shown in the drawings, supplementary lower nozzles intermediate the ends of the tank may also be used in the batch cooling embodiment illustrated in FIGS. 1–9, and such supplementary nozzles are particularly desirable when cooling relatively long slabs. If necessary, supplementary cooling water nozzles may also be located at the upper portion of the tank 116, e.g. as shown in broken lines at 126, to assist in cooling the upper surfaces of the slabs.

As will be evident from FIGS. 10 and 11, sealing and cooling water is introduced into the tank 116 at both ends and flows toward the center of the tank from both directions. Thus, water from the nozzles 121 and 123 flows from the right-hand portion of the tank toward the center, and water from the nozzles 122, 124, and 126 flows from the left-hand portion of the tank toward the center. A pair of water outlet compartments 127 are located centrally of the tank 116 at opposite sides thereof. As seen in FIG. 12, each compartment 127 has a bottom grill 128, and each compartment 127 communicates with the tank 116 through openings 129 and 131 in the tank wall 132. As in the previously described embodiment, the openings 129 and 131 are controlled by gates 133 and 134, respectively. The electric motor drives for the rollers 117 have been omitted from FIGS. 10–12 for simplicity, but in the case of roller 117*a* located between the drain compartments 127, it will be evident that this roller will be driven most conveniently by means of a driving connection with an adjacent motor driven roller, or in some cases the roller 117*a* may simply be a non-driven or idler roller.

The cooling apparatus of the present invention has the important advantages of relatively low capital cost as compared with other types of equipment, lower water flow rates than conventional spray systems, freedom from the maintenance problems associated with conventional spray systems, and the ability to provide rapid uniform cooling. In addition, the large cooling inventories characteristic of air cooling are eliminated. Furthermore, scale formation is minimized as compared with air cooling, and due to the rapid cooling effect any scale present tends to pop off resulting in a relatively clean slab surface. Inspection of the slab is very convenient because of the clean surface and because the slab is at a low enough temperature for easy handling. Moreover, the cooling of low carbon steel slabs can be effected without warping or cracking.

As an example, using equipment generally similar to that shown in FIGS. 1–9*b*, it was found possible to cool 8 to 10 inch thick slabs of low carbon aluminum-killed steel from 1600° F. to 400° F. in about 15 to 25 minutes without warping or cracking and with minimum scale formation. The operation of the cooler was not significantly affected by the slab thickness or the cooling water temperature, and the rate of heat transfer was found to be limited primarily by the rate of heat conduction in the slab. The slit orifice 78 in the upper nozzle 66 was 0.375 inch by 72 inches, and in the lower nozzle 66 the slit orifice was 0.500 inch by 72 inches. The angle A of the upper orifice was 17° and the angle A of the lower orifice was 15°. The water flow rate was 4600 gallons per minute supplied to the two nozzles. The operating pressure at the upper nozzle was 7 pounds per square inch gage and at the lower nozzle was 12 pounds per square inch gage.

Although the invention has been described with particular reference to certain specific structural embodiments, it is to be understood that various modifications and equivalent structures may be resorted to without departing from the scope of the invention as defined in the appended claims.

We claim:

1. A method of cooling work-pieces, comprising:

introducing a work-piece horizontally into a cooling liquid bath and moving the work-piece through the bath while supporting the work-piece beneath the surface of the bath;

introducing cooling liquid into the bath adjacent the entry of the work-piece to the bath and causing it to flow through the bath along the surfaces of the work-piece parallel to the direction of introduction of the work-piece and out of the bath; and during at least the initial portion of the cooling period restricting the flow of at least a portion of the cooling liquid to a confined channel at the underside of the work-piece;

said cooling liquid being introduced into said bath as a pair of angularly intersecting liquid curtains impinging against the upper and lower surfaces of the work-piece beneath the bath surface;

said work-piece being moved through said curtains into said bath so as to prevent any substantial flow of liquid out of said bath at said entry; and said channel having an inlet end positioned so that the cooling liquid curtain impinging against the lower surface of the work-piece is diverted into said inlet end and flows through said channel at high velocity.

2. The method of claim 1 further characterized in that a portion of a work-piece is always disposed in the liquid curtains during a cooling operation.

3. The method of claim 1 further characterized in that the work-piece is moved horizontally in one direction into the bath and upon completion of the cooling is withdrawn in the opposite direction from the bath.

4. The method of claim 1 further characterized in that the bath is contained in an elongated tank, and the work-piece is moved horizontally into the bath at one end of the tank and is removed horizontally from the bath at the opposite end of the tank.

5. The method of claim 4 further characterized in that a pair of angularly intersecting cooling liquid curtains are also provided at said opposite end of said tank and the work-piece is withdrawn therethrough.

6. The method of claim 4 further characterized in that a plurality of work-pieces are moved through said bath in end-to-end abutted relation so that a portion of a work-piece is always disposed in the liquid curtains during a cooling operation.

7. The method of claim 1 further characterized in that additional cooling liquid is introduced into said channel at a location spaced downstream from the entry of the work-piece to the bath.

8. The method of claim 1 further characterized in that cooling liquid is removed from the bath remote from the entry of the work-piece to the bath through a pair of outlets, and the distribution of liquid flow between said outlets is controlled to maintain a desired flow velocity over the work-piece surfaces and a desired liquid level in said bath.

9. The method of claim 1 further characterized by the additional step of controlling the flow of cooling liquid out of the bath to maintain a desired flow velocity over the work-piece surfaces and a desired liquid level in the bath.

10. A method of cooling work-pieces, comprising:

introducing a work-piece horizontally into a cooling liquid bath and moving the work-piece through the bath while supporting the work-piece beneath the surface of the bath;

introducing cooling liquid into the bath adjacent the entry of the work-piece to the bath and causing it to flow through the bath along the surfaces of the work-piece parallel to the direction of introduction of the work-piece and out of the bath; and during at least the initial portion of the cooling period restricting the flow of at least a portion of the cooling liquid to a confined channel at the underside of the work-piece;

said cooling liquid being introduced into said bath as a pair of angularly intersecting liquid curtains directed inwardly of the bath at an angle of from about 10° to about 25° to the horizontal; and said work-piece being moved through said curtains into said bath so as to prevent any substantial flow of liquid out of said bath at said entry.

* * * * *